US005815786A

United States Patent [19]

Isemura

[11] Patent Number: 5,815,786

[45] Date of Patent: Sep. 29, 1998

[54] COPIER APPARATUS

[75] Inventor: Keizo Isemura, Koganei, Japan

[73] Assignee: Canon Kabushiki Kaisha, Tokyo, Japan

[21] Appl. No.: 735,398

[22] Filed: Oct. 21, 1996

[30] Foreign Application Priority Data

Oct. 24, 1995 [JP] Japan ..... 7-275767

[51] Int. Cl.[6] ..... G03G 15/00

[52] U.S. Cl. ..... 399/376; 399/370

[58] Field of Search ..... 399/376, 389, 399/370

[56] References Cited

U.S. PATENT DOCUMENTS

| | | | |
|---|---|---|---|
| 4,260,248 | 4/1981 | Murata et al. | 355/60 |
| 4,455,081 | 6/1984 | Yoshimura et al. | 399/86 |
| 4,647,189 | 3/1987 | Fujiwara et al. . | |
| 4,696,563 | 9/1987 | Shibusawa | 399/204 |
| 4,702,589 | 10/1987 | Ito | 399/390 |
| 4,897,695 | 1/1990 | Ito et al. . | |
| 4,939,553 | 7/1990 | Sato et al. . | |
| 5,036,354 | 7/1991 | Miyamoto . | |
| 5,130,757 | 7/1992 | Ito . | |
| 5,237,379 | 8/1993 | Sklut et al. . | |
| 5,287,159 | 2/1994 | Sakakibara . | |
| 5,311,248 | 5/1994 | Iwata | 355/61 |
| 5,311,259 | 5/1994 | Moriya et al. | 399/86 |
| 5,500,725 | 3/1996 | Takasu et al. . | |
| 5,541,713 | 7/1996 | Takatsuki et al. | 399/376 |

FOREIGN PATENT DOCUMENTS

| | | |
|---|---|---|
| 3537012 | 4/1986 | Germany . |
| 2 237 886 | 5/1991 | Germany . |
| 4316809 | 11/1993 | Germany . |
| 1-000967 | 1/1989 | Japan . |
| 6-276383 | 9/1994 | Japan . |
| 7-114300 | 5/1995 | Japan . |
| WO 94/22264 | 9/1994 | WIPO . |

*Primary Examiner*—Matthew S. Smith
*Attorney, Agent, or Firm*—Fitzpatrick, Cella, Harper & Scinto

[57] ABSTRACT

A copier has an operating mode in which copying is performed upon closing the cover of a platen and use is made of the size of an original to copy the original. An example is a mode in which the image of an original is divided up into a plurality of blocks and the images of the respective blocks are enlarged and each is copied on a separate sheet of copy paper. In such a scenario, it is determined whether the size of the original is capable of being sensed by sensors. If it is determined that sensing is not possible, processing for inferring the shape of the original is executed. In accordance with this processing, the size and orientation of the copy paper as well as the currently prevailing copying mode are checked, then the size and orientation of the original are inferred based upon the results of the check. Even if the size of the original is cannot be sensed, therefore, it is possible to infer the size and execute copying accordingly.

21 Claims, 11 Drawing Sheets

FIG. 3A

| SENSOR 3 | SENSOR 2 | SENSOR 1 | SENSOR 0 | AB-BASED |
|---|---|---|---|---|
| 0 | 0 | 0 | 0 | NONE |
| 0 | 0 | 0 | 1 | B5R |
| 0 | 1 | 0 | 0 | B5 |
| 1 | 1 | 0 | 0 | A4 |
| 0 | 0 | 1 | 1 | A4R |
| 0 | 1 | 1 | 1 | B4 |
| 1 | 1 | 1 | 1 | A3 |

FIG. 3B

| SENSOR 2 | SENSOR 1 | SENSOR 0 | INCH-BASED |
|---|---|---|---|
| 0 | 0 | 0 | NONE |
| 0 | 0 | 1 | LTRR |
| 0 | 1 | 1 | LGL |
| 1 | 0 | 0 | LTR |
| 1 | 1 | 1 | 11×17 |

FIG. 10

| PAPER SIZE AND ORIENTATION | MODE | INFERRED SIDE AND ORIENTATION OF ORIGINAL |
|---|---|---|
| A5 | SIMPLE REDUCTION MODE | A5, VERTICAL |
| A5R | SIMPLE REDUCTION MODE | A5, HORIZONTAL (A5R) |
| A5 | 1 TO 2 | A5, HORIZONTAL (A5R) |
| A5 | 1 TO 4 | A5, VERTICAL |
| A5R | 1 TO 2 | A5, VERTICAL |

800

COPIER APPARATUS

BACKGROUND OF THE INVENTION

This invention relates to a copier apparatus which infers the size of an original to be copied.

Copiers according to the prior art are provided with original size sensing means for sensing the size of a document original to be copied. These copiers use the sensing means to sense the size of an original placed upon a platen and control the copying operation based upon the size of the image sensed. In a situation where the size of an original cannot be sensed by such sensing means, processing is executed upon regarding the original as having the maximum size that can be handled. The reason for this is that part of the image will be missing from the resulting copy if an original of indeterminate size is treated as being smaller than its actual size.

However, copiers having a variety of copying modes have been invented and originals of small size are used. In addition, there are also copying modes in which copying magnification is calculated based upon the size of the original and a set paper size, and in which the image is moved. If the size of the original is not accurately recognized in such modes, an image having too large a white area is outputted or images are lost.

SUMMARY OF THE INVENTION

An object of the present invention is to provide a copier apparatus and a method of controlling same in which the aforementioned problems are solved.

Another object of the present invention is to provide a copier apparatus and a method of controlling same in which, even when the size of an original cannot be sensed, copying is executed upon inferring the size of the original from set copying conditions.

A further object of the present invention is to provide a copier apparatus and a method of controlling same in which it is possible to sense the size of an original having a fixed size that is smaller than a usually sensible fixed minimum size.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIGS. 3A and 3B are diagrams illustrating the correspondence between the sensing of density by reflection-type sensors and the sizes of originals;

FIG. 10 is a diagram illustrating an example of the sizes and orientations of originals inferred from paper size, orientation and mode setting;

DESCRIPTION OF THE PREFERRED EMBODIMENT

A preferred embodiment of the present invention will now be described with reference to the drawings.

Figure 1:
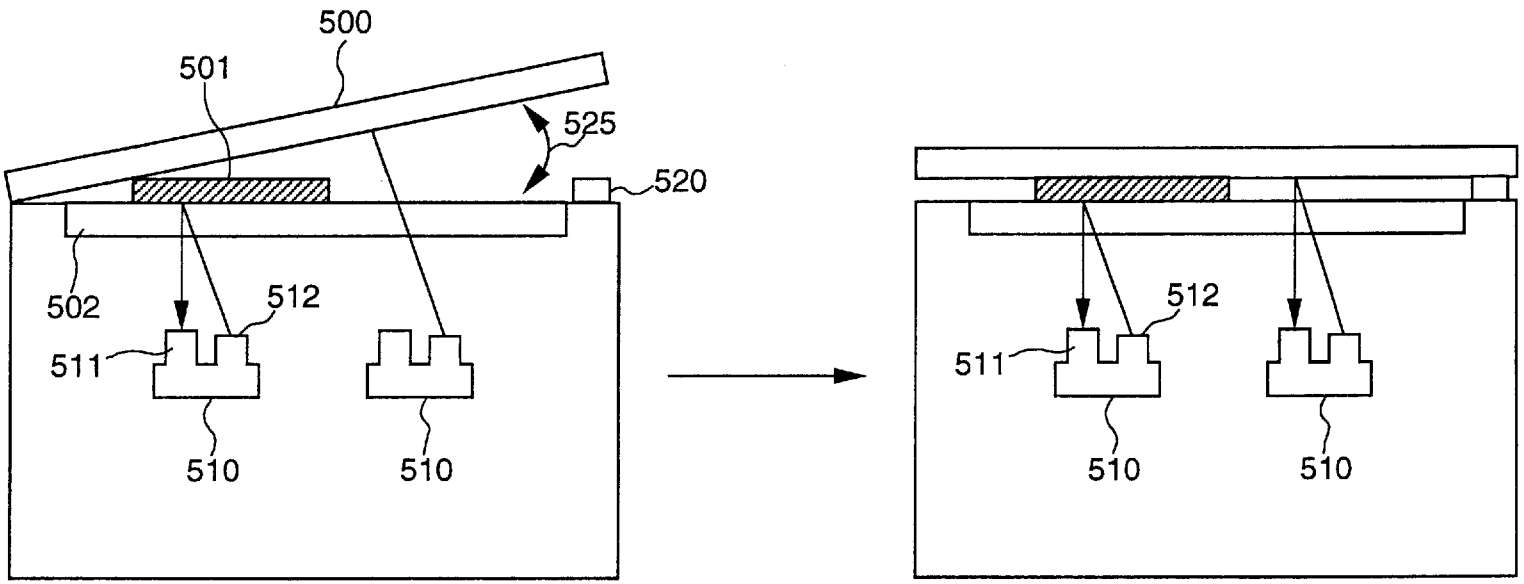
FIG. 1 is a diagram illustrating the conceptual configuration of a mechanism for sensing the size of an original.

FIG. 1 is a diagram illustrating the conceptual configuration of a mechanism for sensing the size of an original. Shown in FIG. 1 are a platen cover 500 of a copier, an original 501, and a platen glass 502 which functions as a platen. When the platen cover 500 is closed to define a predetermined angle 525, a sensor 520 for sensing a angle defined by the platen cover 500 and platen glass 502 sends a CPU (which corresponds to 530 described later) an output signal indicating that the platen cover 500 has been closed to the predetermined angle 525. On the basis of this signal, the CPU controls reflection-type sensors 510 in such a manner that light is projected from an LED 512 toward the platen glass 502. A transistor 511 in each reflection-type sensor 510 senses the density of a reflector (the original 501 or the platen cover 500) from the reflected light. On the basis of the density sensed, the CPU determines whether an original is present above each reflection sensor and recognizes the size of an original as one of various standard sizes. The LED 512 lights for a length of time a little longer than that required for the platen cover 500 to be closed completed from the position of the predetermined angle 525. The LED 512 turns off during copying. The LED 512 preferably is driven only when necessary in order to prevent its deterioration.

Figure 2B:
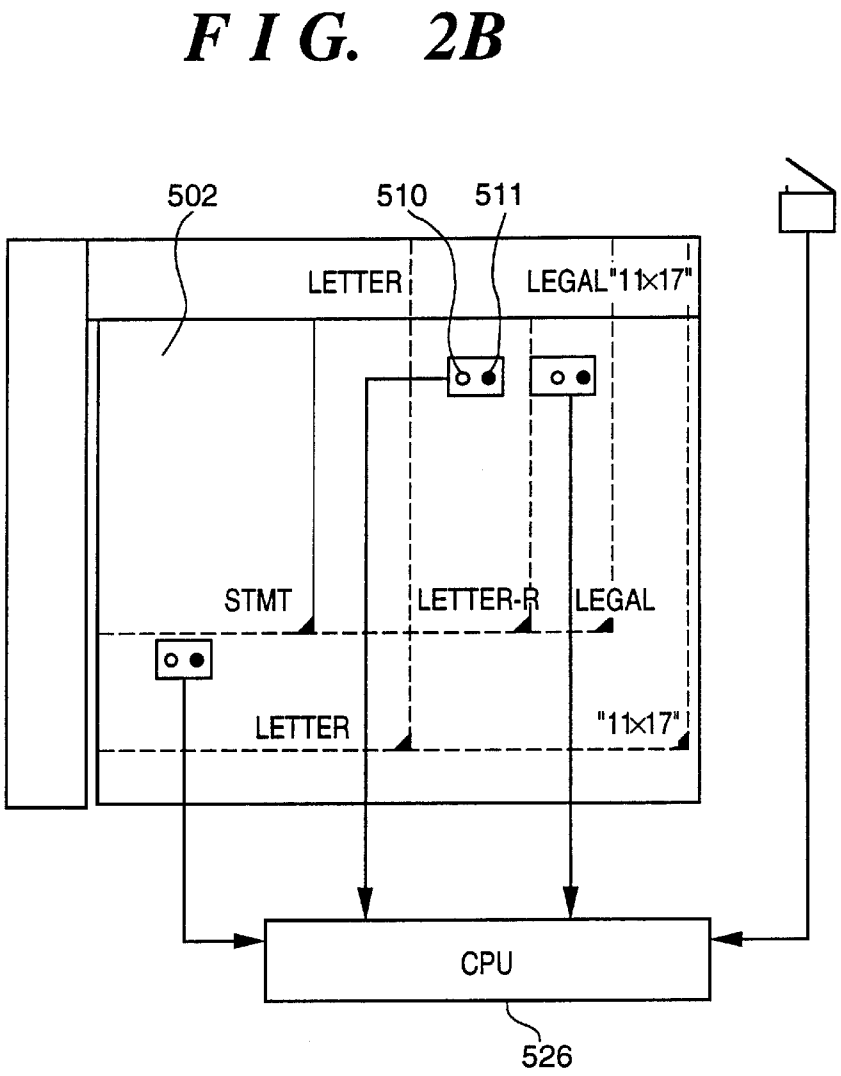
FIGS. 2A and 2B are diagrams illustrating the configuration of a copier as seen from above a glass platen thereof.
Figure 2A:
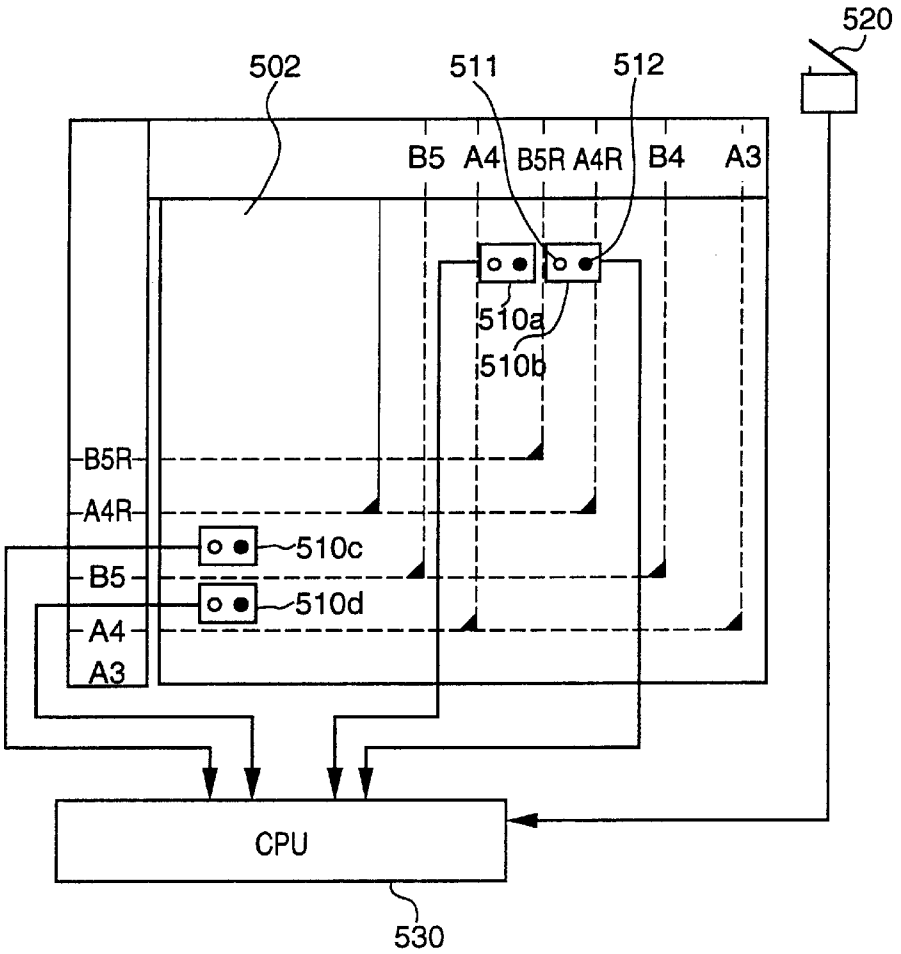

FIGS. 2A and 2B are diagrams illustrating the configuration of a copier as seen from above a glass platen thereof. In FIG. 2A represents an arrangement for AB-based originals (A4, A4R, B5, B5R, B4, A3). Reflection-type sensors 510*a*~510*d* are arranged on the underside of the platen glass 502. The reflection-type sensors 510*a*~510*d* (also referred to as sensors 0~3 below) and the angle sensor 520 are connected to the CPU 530. Further, FIG. 2B represents an arrangement for inch-type originals (LETTER, LEGAL, LETTER-R, 11×17). Reflection-type sensors 510*a*~510*c* are arranged on the underside of the platen glass 502. The reflection-type sensors 510*a*~510*c* (also referred to as sensors 0~2 below) and the angle sensor 520 are connected to the CPU 530.

FIGS. 3A and 3B are diagrams illustrating the correspondence between the sensing of density by reflection-type sensors and the sizes of originals. FIG. 3A illustrates the case for AB-based originals and FIG. 3B the case for inch-type originals. Further, "0" in FIGS. 3A, 3B indicates absence of an original above the sensors and "1" indicates that an original is present above the sensors. For example, when each of the sensors 0~3 indicates presence of an original in the case of an AB-type original, for example, this means the original is size A3. The corresponding relationships illustrated are stored in memory means or the like connected to the CPU 530, for example, so that the CPU 530 is capable of recognizing the size of the original by referring to them.

It should be noted that the above-mentioned method of sensing the size of an original is described in detail in the specification of U.S. Pat. No. 4,939,553.

Figure 4:
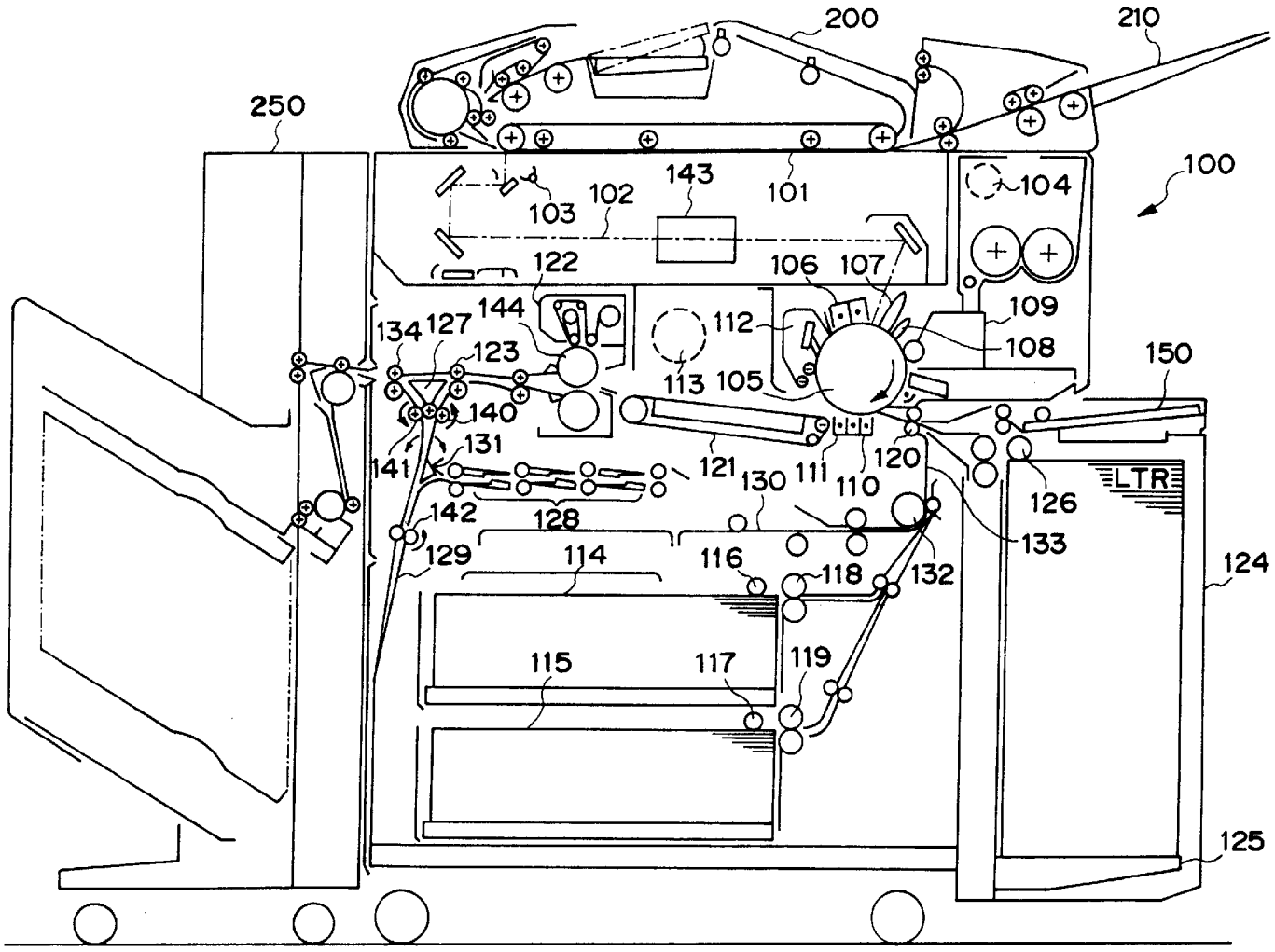
FIG. 4 is a diagram showing an example of the construction of a copier.

FIG. 4 is a diagram illustrating an example of the construction of a copier. Shown in FIG. 4 are a main body 100 of a copier apparatus, a circulating-type automatic document feeding unit (feeder) 200 for automatically feeding originals, and a sorting unit (sorter) 250. It is so arranged that the feeder 200 and sorter 250 are capable of being used in any combination with the main body 100.

A platen glass 101 (which corresponds to 502 above) serves as a document platen, and an optical system 102 functions as image reading means. The optical system 102 is composed of a document illuminating lamp (exposure lamp) 103, a scanning mirror, a lens 143 and a motor 104, etc. A document is illuminated by the exposure lamp 103 while the lamp is caused to scan by the motor 104. Light reflected from the document irradiates a photosensitive drum 105 via the scanning mirror and lens 143. Provided about the photosensitive drum 105 are a primary corona discharge device 106, a black exposure unit 107, a potential sensor 108, a developing unit 109, a transfer corona discharge device 110, a separating corona discharge device 111, and a cleaning unit 112, etc. Image recording means are constructed by these elements.

The photosensitive drum 105 is rotated in the direction of the illustrated arrow by a main motor 113 and is subjected to corona discharge by the primary corona discharge device 106. When light reflected from a document irradiates the drum from the optical system 102, an electrostatic latent image is formed. The electrostatic latent image is developed by the developing unit 109 and becomes visible as a toner image. Meanwhile, copy paper fed from an upper cassette 114 or lower cassette 115 into the main body 100 by paper feeding rollers 118, 119 via the intermediary of pick-up rollers 116, 117 is supplied to the photosensitive drum 105 upon being timed in such a manner that the leading edge of the copy paper is registered with the leading edge of the toner image by a registration roller 120, after which the toner image is transferred by the transfer corona discharge device 110. After the transfer, the copy paper is separated from the photosensitive drum 105 by the separating corona discharge device 111, the copy paper is introduced to a fixing unit 122 by a conveyor belt 121 so that the image will be fixed by application of pressure and heat, and then the copy paper is ejected from the main body 100 by discharge rollers 123. The photosensitive drum 105 has its surface cleaned by the cleaning unit 112. Furthermore, the cassettes 114, 115 are provided with well-known paper size sensors so that a CPU 1004*a*, described later, is capable of determining the sizes of the paper contained in the cassettes 114, 115.

A deck 124 capable of accommodating, say, 4000 sheets of copy paper is mounted on the main body 100. The deck 124 also is provided with a well-known paper size sensor so that the CPU 1004*a* is capable of determining the size of the paper contained in the deck 124. A lifter 125 of the deck 124 is raised in dependence upon the quantity of copy paper in such a manner that the copy paper is made to contact a paper feeding roller 126.

A paper discharge flapper 127 switches the path between a double-sided recording side or multiple recording side and a discharge side (sorter 250). Copy paper that has been sent from the discharge rollers 123 is switched to the double-sided recording side or multiple recording side by the paper discharge flapper 127.

A multiple flapper 131 which changes over the double-sided recording and multiple recording path is tilted to the left to thereby introduce copy paper to a reversal path 129 or downward conveyance path 128. The downward conveyance path 128 turns over copy paper, which has been delivered from the discharge rollers 123, directly or via the reversal path 129 and then conveys the copy paper to a paper resupply tray 130.

A paper feeding roller 132 feeds copy paper to the side of the photosensitive drum 105 via a path 133. Discharge rollers 134 are arranged in the proximity of the paper discharge flapper 127 and eject copy paper, which has been switched to the discharge side by the paper discharge flapper 127, to the exterior of the main body 100. At the time of double-sided recording (double-sided copying) or multiple recording (multiple copying), the discharge flapper 127 is lifted up so that copy paper that has been copied on is stored in the resupply tray 130 in the reversed state via the conveyance paths 128, 129 (at the time of double-sided recording). Now, the multiple flapper 131 is tilted to the right at the time of double-sided recording and to the left at the time of multiple recording.

At the time of back-side recording or multiple-recording, which is executed next, copy paper that has been accommodated in the resupply tray 130 is introduced, one sheet at a time, from bottom to the registration roller 120 by the paper feeding roller 132 via the path 133.

When recording paper is ejected from the main body 100 upon being turned over, the paper discharge flapper 127 is lifted up, the flapper 131 is tilted to the right and copy paper that has been copied on is conveyed to the conveyance path 129. After the trailing edge of the copy paper passes a feed roller 140, the copy paper is conveyed to a feed roller 141 by a reversing roller 142 and the copy paper is turned over and ejected to the outside by the discharge roller 134.

Figure 5:
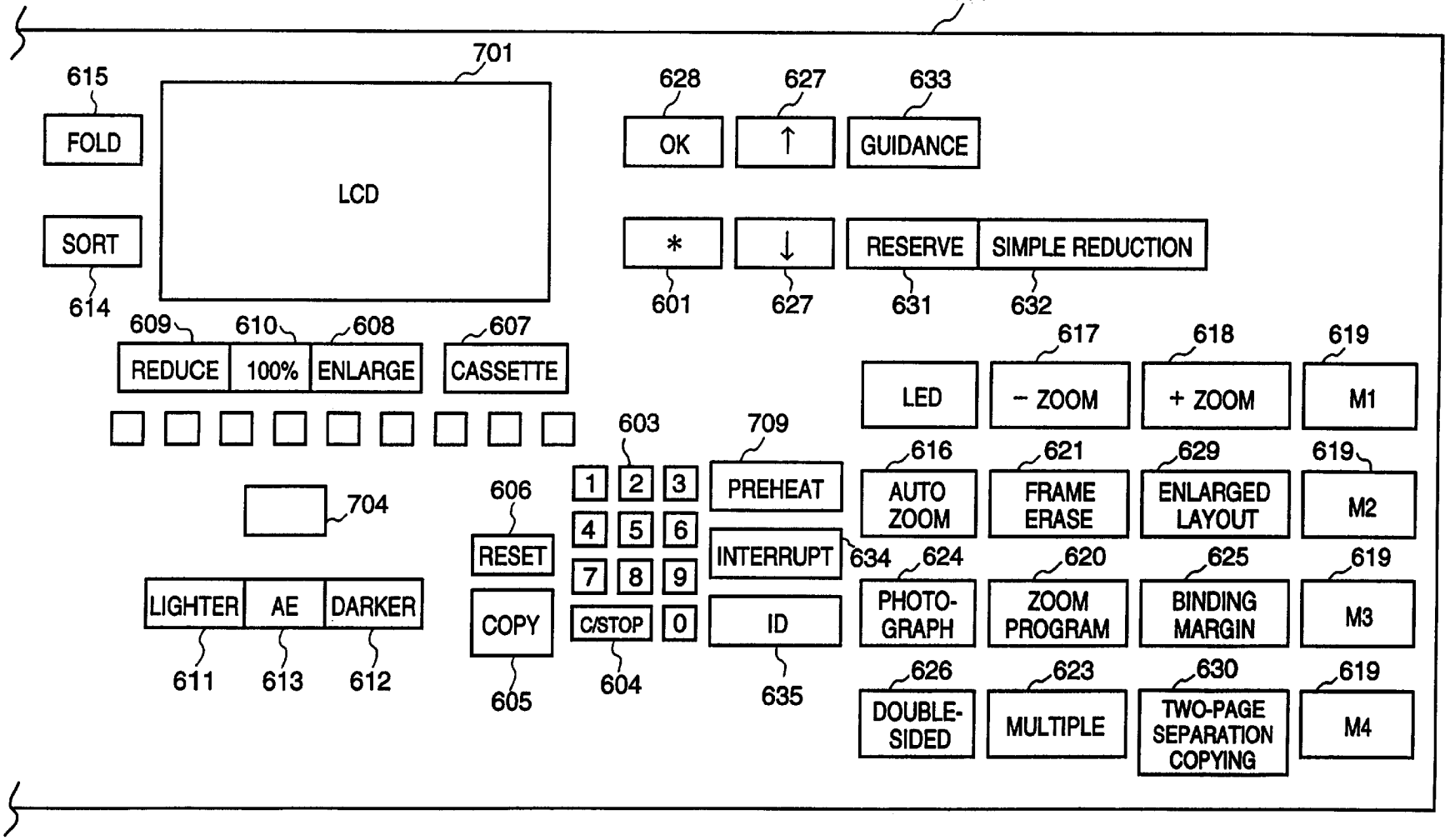
FIG. 5 is a diagram showing an example of the arrangement of a control panel provided on a copier body.

FIG. 5 is a diagram showing an example of the arrangement of a control panel 600 provided on the copier body 100. A user mode key 601 is used to set the specifications of the copier and a standard mode, etc., and when cleaning is performed. Cursors key 627 are used when an item to be set is selected at the time of a mode setting. An OK key 628 is used when set content is made definite at the time of a mode setting.

An all-reset key 606 is used when a setting is restored to the standard mode. A copy start key 605 is used when copying is started. A clear/stop key 604 functions as a clear key during standby and as a stop key during copying. When the key functions as a clear key, a set number of copies can be canceled. When the key functions as a stop key, continuous copying can be suspended, in which case copy processing is stopped upon completion of the copy processing being performed at the moment the key was pressed.

A ten-key pad 603 are used when setting the number of copies and also when setting a numerical value for the purpose of selecting a mode. Memory keys 619 are used when the operator registers frequently used modes. In this example, it is possible to register four modes Ml~M4. Copy density keys 611 and 612 are used when copying density is adjusted manually. An AE key 513 is used when switching between an AE (automatic density adjustment) mode, which is for adjusting copying density automatically in conformity with the density of a document, and a manual mode, which is for adjusting density manually.

A copy paper selection key 607 is used when selecting the upper paper lifter 114, lower paper lifter 115, paper deck 124 and a multiple manual-insertion unit 150. When documents have been placed in the feeder 200, an APS (automatic paper cassette selection) mechanism can be designated by the copy paper selection key 607.

A 100% copy key 610 is used when performing copying at the same magnification (actual scale). An automatic zoom key 616 is used when automatically designating reduction/enlargement for the image of a document in conformity with the size of the designated copy paper. Double-side key 626 is used when making double-sided copies from single-sided documents, double-sided copies from double-sided documents and single-sided copies from double-sided documents. A binding margin key 625 is used when creating a binding margin, of a designated length, on either the left, right, top or bottom side of a sheet of copy paper. A photograph key 624 is used when copying a photographic original. A multiple key 623 is used when forming (combining) the images from two documents on the same side of a sheet of copy paper. A frame erase key 621 is used when setting document frame erasure, sheet frame erasure, punched-hole erasure and book frame erasure, etc. A zoom program key 620 is used when entering length of a document and length of copy paper, calculating a magnification for such length and performing copying at this magnification.

An enlargement layout setting key 629 is for designating a mode in which a plurality of reduced documents laid out as a single original are restored to their original selves as a plurality of individual documents. A two-page separation copy key 630 is used when continuously copying left and right pages of a spread book or the like. A simple reduction key 632 is a key for selecting a mode in which the image of the original is somewhat reduced.

A guidance key 633 is used when a description of the functions corresponding to the various keys is displayed on a message display 701. A paper-discharge method selection key 614 is a key for selecting a paper discharge method, namely stapling and sorting, sorting and grouping. In a case where a stapling sorter has been connected, the key 614 is used when designating selection of a stapling and sorting mode, sorting mode and group mode and when designating cancellation of these modes. A reservation key 631 is used when starting setting of a copying mode for reserved documents placed in a reservation tray 210, and when canceling this reservation setting.

The message display 701 is a display device of LCD (liquid crystal display) type for displaying information (e.g., set conditions) relating to copying and functions as a touch panel as well. By way of example, the message display 701 displays the number of copies set by the ten-key pad 603, copying magnification set by the fixed zoom keys 608, 609, 100% key 610 and zoom keys 617, 618, paper size selected by the paper selection key 507, messages indicating the status of the copier body 100, guidance messages indicating an operating procedure, and set content in various modes. An AE indicator 704 lights when the AE (automatic density adjustment) mode has been selected by the AE key 613. An overheat indicator 705 lights when the copier overheats.

Figure 6:
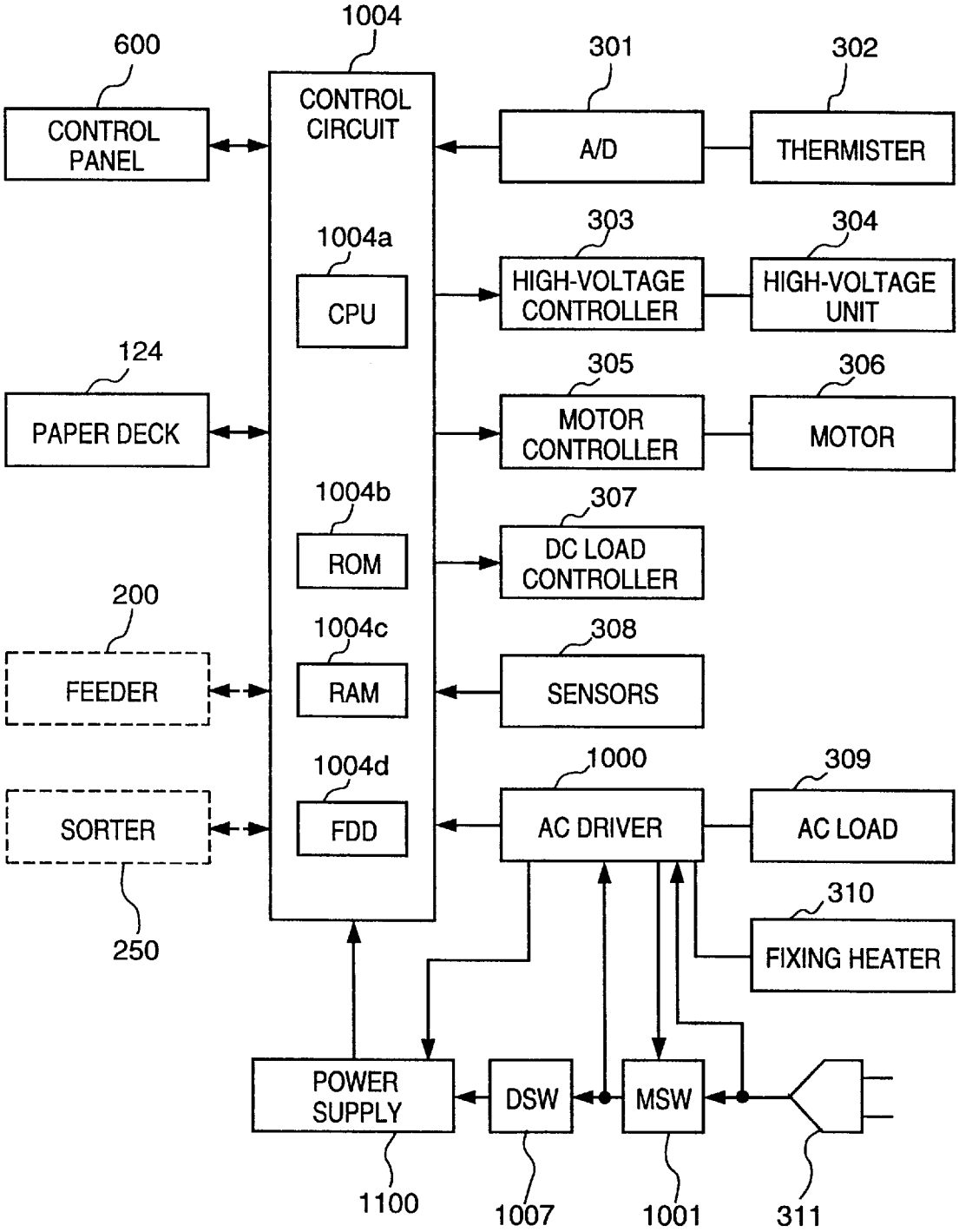
FIG. 6 is a block diagram illustrating an example of the architecture of the control system of a copier.

FIG. 6 is a block diagram illustrating an example of the architecture of the control system of the copier. A control circuit 1004 controls the overall copier and includes a CPU 1004*a*, a ROM 1004*b*, a RAM 1004*c* and a floppy disk drive (FDD) 1004*d*. The ROM 1004*b* is a memory which stores program codes supplied to the CPU 1004*a*. The programs include a copy processing program (see FIG. 7), described later, in addition to an ordinary program for overall control of the copier.

The control panel 600 includes a key input section of keys for setting various copy modes (e.g., single-sided, double-sided and multiple modes, copying magnification and cassette selection, etc.), a ten-key pad for setting number of copies, etc., a start key for designating start of a copying operation, a stop key for designating stopping of a copying operation, and a reset key for restoring the operating mode to the standard state, and a message display such as LEDs or liquid- crystal for displaying the set states of operating modes, etc.

A thermister 302 detects the surface temperature of a fixing roller 144. An analog value indicating the surface temperature sensed is supplied to an A/D converter 301, where the analog value is converted to digital data that enters the control circuit 1004. On the basis of the data (surface temperature) supplied from the thermister 302 via the A/D converter, the control circuit 1004 performs control in such a manner that the surface temperature of the fixing roller 144 attains a predetermined value.

A high-voltage controller 303 controls a high-voltage unit 304 which applies a predetermined potential to the corona discharge system having the primary corona discharge device 106 and transfer corona discharge device 110, etc., and to the developing unit 109. A motor controller 305 controls the drive of motors 306 such as various stepping motors and a main drive motor. A DC load controller 307 controls solenoids for the pick-up roller 116 and the like, the clutch for the registration roller 120 and the driving of a fan, etc. Sensors 308 sense jamming of copy paper and apply their output signals to the control circuit 1004.

An AC driver 1000 controls the supply of AC power to an AC load 309, such as the document illuminating lamp 103, and to a fixing heater 310. Further, the AC driver 1000 detects malfunctions in the document illuminating lamp 103, fixing heater 310, etc., and places a main switch (MSW) 1001, which is equipped with a shut-off mechanism, in the off state. Further, under the control of the control circuit 1004, the AC driver 1000 switches over the AC input of the main switch 1001 and enters it into a power supply 1100.

The power supply 1100 supplies the control circuit 1004 and the like with DC power. The power supply 1100 is provided with AC power from the AC driver 1000 and is supplied with AC power from an input power-supply plug 311 via the main switch 1001 and a door switch 1007.

The paper deck 124 is a paper supply device for increasing the number of sheets of copy paper that can be stacked, the feeder 200 is an automatic document feeding device for setting a plurality of documents automatically, and the sorter 250 is a device for sorting sheets of copy paper that have been discharged.

The operation of the copier will now be described. In this embodiment, the arrangement is such that if the size of a document cannot be sensed, the document size is inferred from the set copying mode and the size of the copy paper. The copying modes in this case are the simple reduction mode and the enlargement layout mode, by way of example.

Figure 8:
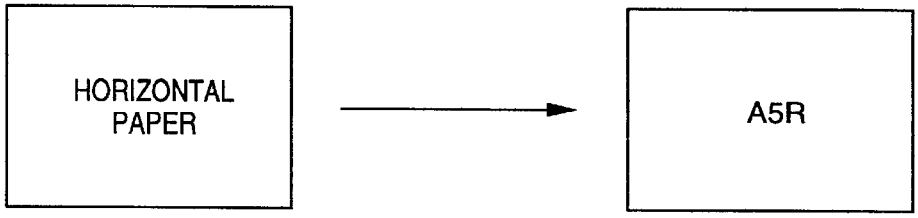
FIG. 8 is a diagram conceptually illustrating processing for inferring the size and orientation of an original in a simple reduction mode.

FIG. 8 is a diagram conceptually illustrating processing for inferring the size and orientation of an original in a simple reduction mode. As mentioned above, the simple reduction mode somewhat reduces (on the order of 93%) the image of the original document and copies the image on copy paper whose size is the same as that of the original, by way of example. If horizontally disposed copy paper has been selected at this time, for example, then the copier infers that the original also is disposed horizontally. Conversely, if vertically disposed copy paper has been selected, then the apparatus infers that the original also is disposed vertically. Accordingly, having the operator select the size of the copy paper causes the copier to recognize the size of the original. Further, having the operator select the orientation of the copy paper causes the copier to recognize the orientation of the original. In other words, even if the copier cannot sense the size and orientation of a document placed on the platen glass 500, the copier is capable of inferring the size and orientation of the document from the selected size and orientation of the copy paper. This makes it possible to reduce copying mistakes arising from the fact that document size cannot be sensed, and enables copying processing to be made more efficient. It should be noted that paper size and orientation usually are selected collectively (e.g., size A4 and vertical disposition in case of "A4" and size A4 and horizontal disposition in case of "A4R").

Figure 9A:
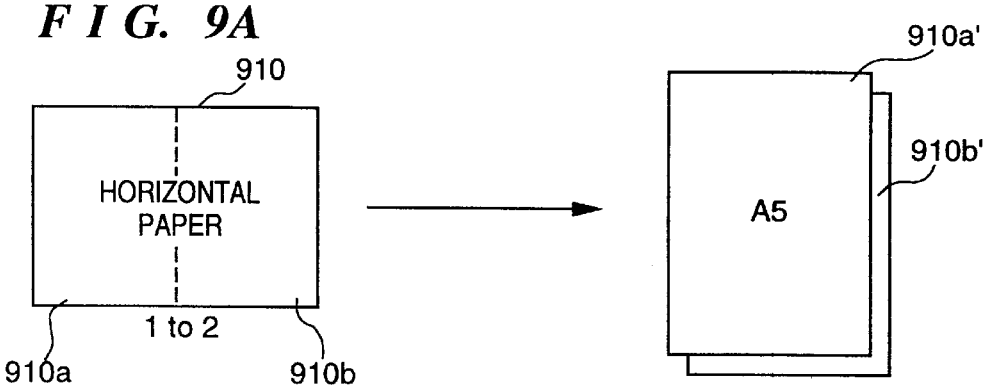
FIGS. 9A through 9C are diagrams conceptually illustrating processing for inferring the size and orientation of an original in an enlarged layout mode.
Figure 9B:
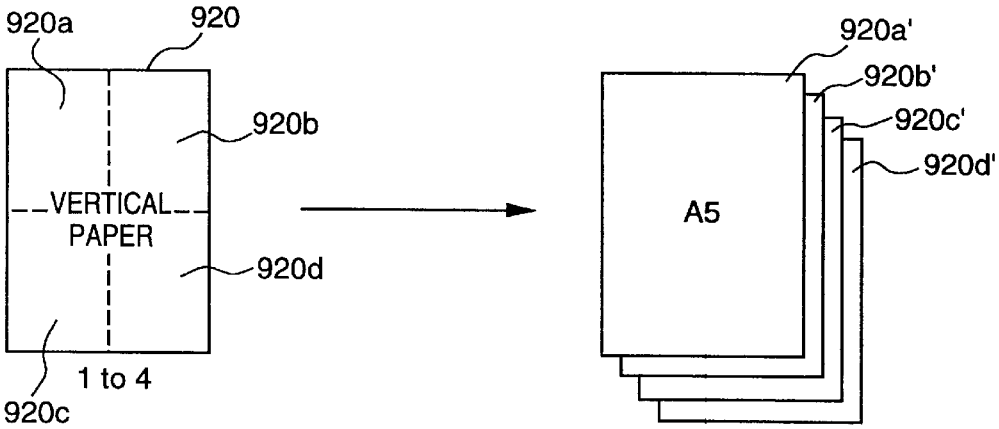
Figure 9C:
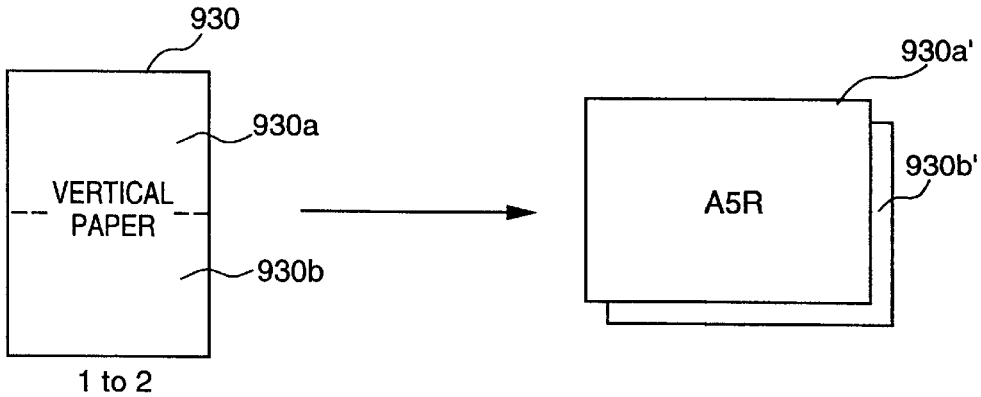

FIGS. 9A through 9C are diagrams conceptually illustrating processing for estimating the size and orientation of an original in an enlarged layout mode. As mentioned above, the enlarged layout mode is a mode in which a plurality of reduced documents laid out in the form of a single original are restored from this form to the plurality of documents in their original form. In other words, the enlarged layout mode is a mode in which a single original document is divided up into a plurality of blocks and the image of each block is enlarged and copied on its own sheet of paper.

FIG. 9A illustrates a 1-to-2 mode wherein two images 910*a* and 910*b* in a single original 910, are each enlarged to obtain copied images 910*a*' and 910*b*', respectively. This is a case in which vertically disposed paper has been selected. In other words, if the 1-to-2 mode in enlargement layout (a mode in which a single original is divided in half and each half is then copied) and paper of size A5 (vertical) have been selected, the copier is capable of inferring that the size and orientation of the original 910 are A5 and horizontal, respectively.

FIG. 9B illustrates a 1-to-4 mode wherein four images 920*a*~920*d* in a single original 920, are each enlarged to obtain copied images 920*a*'~920*d*', respectively. This is a case in which vertically disposed paper has been selected. In other words, if the 1-to-4 mode in enlargement layout (a mode in which a single original is divided in four blocks and each block is then copied) and paper of size A5 (vertical) have been selected, the copier is capable of inferring that the size and orientation of the original 920 are A5 and vertical, respectively.

FIG. 9C illustrates a 1-to-2 mode wherein two images 930*a* and 930*b* in a single original 930, are each enlarged to obtain copied images 930*a*' and 930*b*', respectively. This is a case in which horizontally disposed paper has been selected. In other words, if the 1-to-2 mode in enlargement layout and paper of size A5 (horizontal; A5R) have been selected, the copier is capable of inferring that the size and orientation of the original 930 are A5 and vertical, respectively.

Thus, if the enlargement layout mode such as the 1-to-2 or 1-to-4 mode is selected and paper size (e.g., A5) and orientation (vertical or horizontal) are selected in a state in which the size of the original document cannot be sensed, the copier is capable of inferring the size (e.g., A5) of the original and its orientation from the set conditions.

Figure 7:
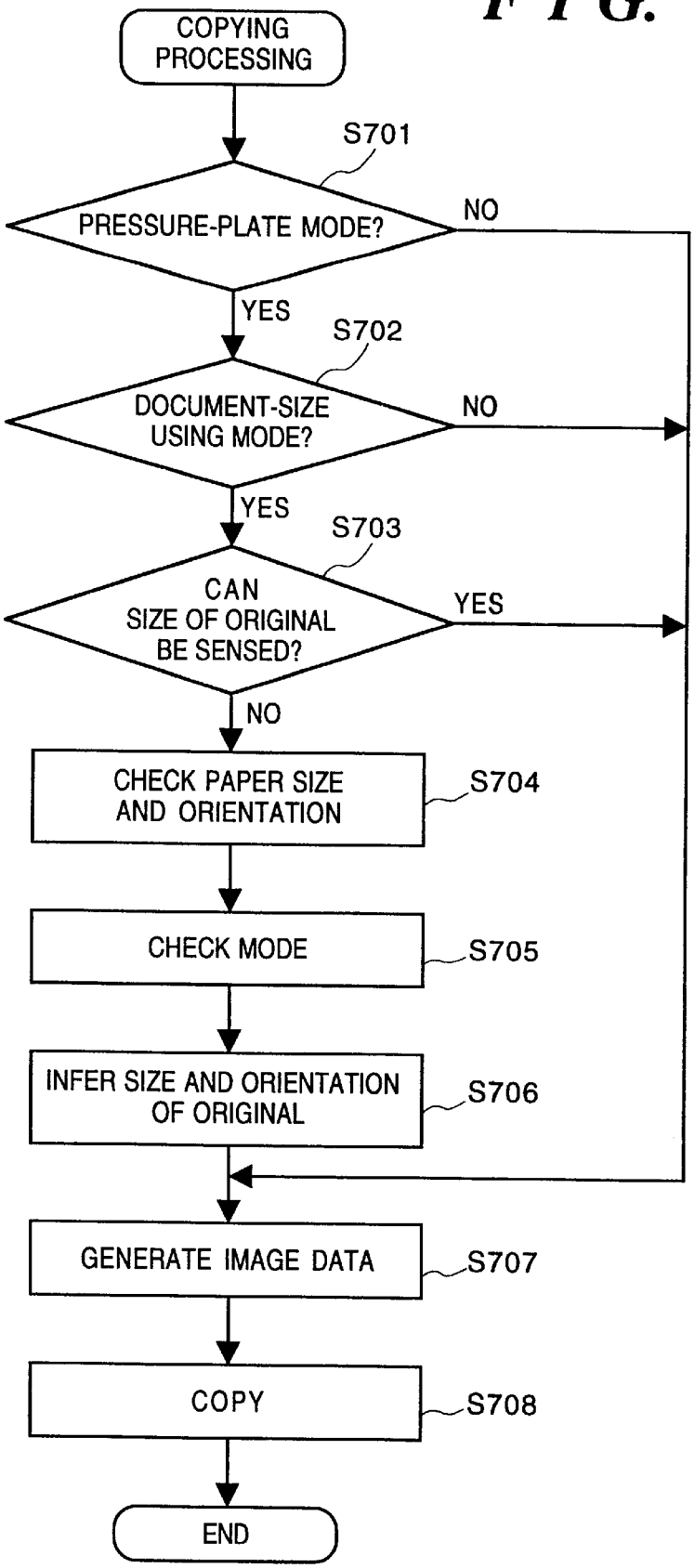
FIG. 7 is a flowchart illustrating the flow of copier control.

FIG. 7 is a flowchart illustrating the flow of copier control. This processing is executed in response to pressing of the copy start key 605, which commands the start of copying, after various modes relating to copying processing and paper size have been set. The copying processing program relating to this flowchart is stored in the ROM 1004*b* in advance, as mentioned above. However, it is also possible to store this program on a floppy disk and then supply the program from the floppy disk drive (FDD) 1004*d*. In such case adding the functions of processing for inferring an original according to this embodiment onto the functions of an already existing copier can be performed with ease.

First, at step S701, it is determined whether the mode relating to the size of an original is a pressure-plate mode or DH mode. The pressure-plate mode is one in which an original is placed manually on the platen glass 502 and the original is copied upon closing the platen cover 500. In other words, this is a mode in which the size of the original is sensed using the sensors 510 and copying processing is executed based upon size sensed, as described above. On the other hand, the DH mode is one an original is placed manually on the platen glass 502 and the original is copied leaving the platen cover 500 open. If the result of the determination is that the prevailing mode is the pressure-plate mode, then the program proceeds to step S702. If the prevailing mode is the DH mode, then the program proceeds to step S707 and copying is executed as is in the mode that has been set.

It is determined at step S702 whether the mode of copying is a document-size using mode that requires information relating to the size and orientation of the original document (e.g., the simple reduction mode, the enlargement layout mode, etc.). If the result is that the prevailing mode is the document-size using mode, then the program proceeds to step S703; otherwise, the program proceeds to step S707.

It is determined at step S703 whether the size of the original document can be sensed by the reflection sensors 510. The program proceeds to step S707 if the size of the original document can be sensed. The reason for this is that the size and orientation of the original can be recognized without executing the ensuing processing (steps S704~S706) for inferring the type of original. If the size of the original cannot be sensed, however, the program proceeds to step S704 and the processing (steps S704~S706) for inferring the size and shape of the original is executed.

The set paper size and orientation are checked at step S704. In this embodiment, A4, B5 and A5, for example, are capable of being selected as vertically oriented paper and A5R, A4R, B5R, B4 and A3 are capable of being selected as horizontally oriented paper.

The set mode is checked at step S705. In this embodiment, the simple reduction mode, and enlargement/reduction modes are capable of being selected, be way of example.

The size and orientation of the original are inferred at step S706 based upon size and orientation of the paper verified at step S704 and the mode verified at step S705. For example, in a case where the paper setting is A5R (size A5, horizontal disposition), as shown in FIG. 8, and the simple reduction mode has been set, it is judged that the original document is size A5 and is oriented horizontally. Further, in a case where the paper setting is A5 (size A5, vertical disposition) and the simple reduction mode has been set, it is judged that the original document is size A5 and is oriented vertically. In addition, in a case where the paper setting is A5 (size A5, vertical disposition), as shown in FIG. 9A, and the enlargement layout mode (1-to-2) has been set, it is judged that the original document is size A5 and is oriented horizontally. In a case where the paper setting is A5 (size A5, vertical disposition), as shown in FIG. 9B, and the enlargement layout mode (1-to-4) has been set, it is judged that the original document is size A5 and is oriented vertically. In a case where the paper setting is A5 R (size A5, horizontal disposition), as shown in FIG. 9C, and the enlargement layout mode (1-to-2) has been set, it is judged that the original document is size A5 and is oriented horizontally.

FIG. 10 is a diagram illustrating an example of the sizes and orientations of originals inferred from paper size, orientation and mode setting. Such an original-document inference table is stored in, say, the ROM 1004*b*. Furthermore, the original-document inference table, shown at 800, is merely an example for the purpose of describing this embodiment. The paper sizes may be other than those shown and the paper may be inch-based. The modes also may be modes for designating enlargement magnification (e.g., 2×, 4×, etc.) or the enlargement method.

Copy image data corresponding to the set mode are generated at step S707 based upon sensed size and orientation of an original or size and shape of an original as inferred in original-document inference processing. Next, at step S708, an image is formed based upon the image data generated. This completes copying.

Thus, in accordance with this embodiment, as described above, it is possible to reduce copying mistakes arising from the fact that document size cannot be sensed, and it is possible to make copying processing more efficient.

Further, by adding on a control program which infers the size of an original, it is possible to realize a function for inferring original-document size. This makes it possible to easily improve an existing copier by this control program.

The example described above is one in which the size of an original is inferred from the set paper size and mode and copying processing is executed based upon the inferred size of the original. However, scenarios can be conceived in which use of this function is not desired. For example, there are instances where the size of the original document is A5 but it is desired to copy the original on size A5 paper by treating the original as one of size A4 and using the simple reduction mode. In such case, the embodiment described above is such that the document size is inferred to be size A5 based upon the paper size that has been set, as a result of which copying cannot be executed in the manner desired.

Figure 11:
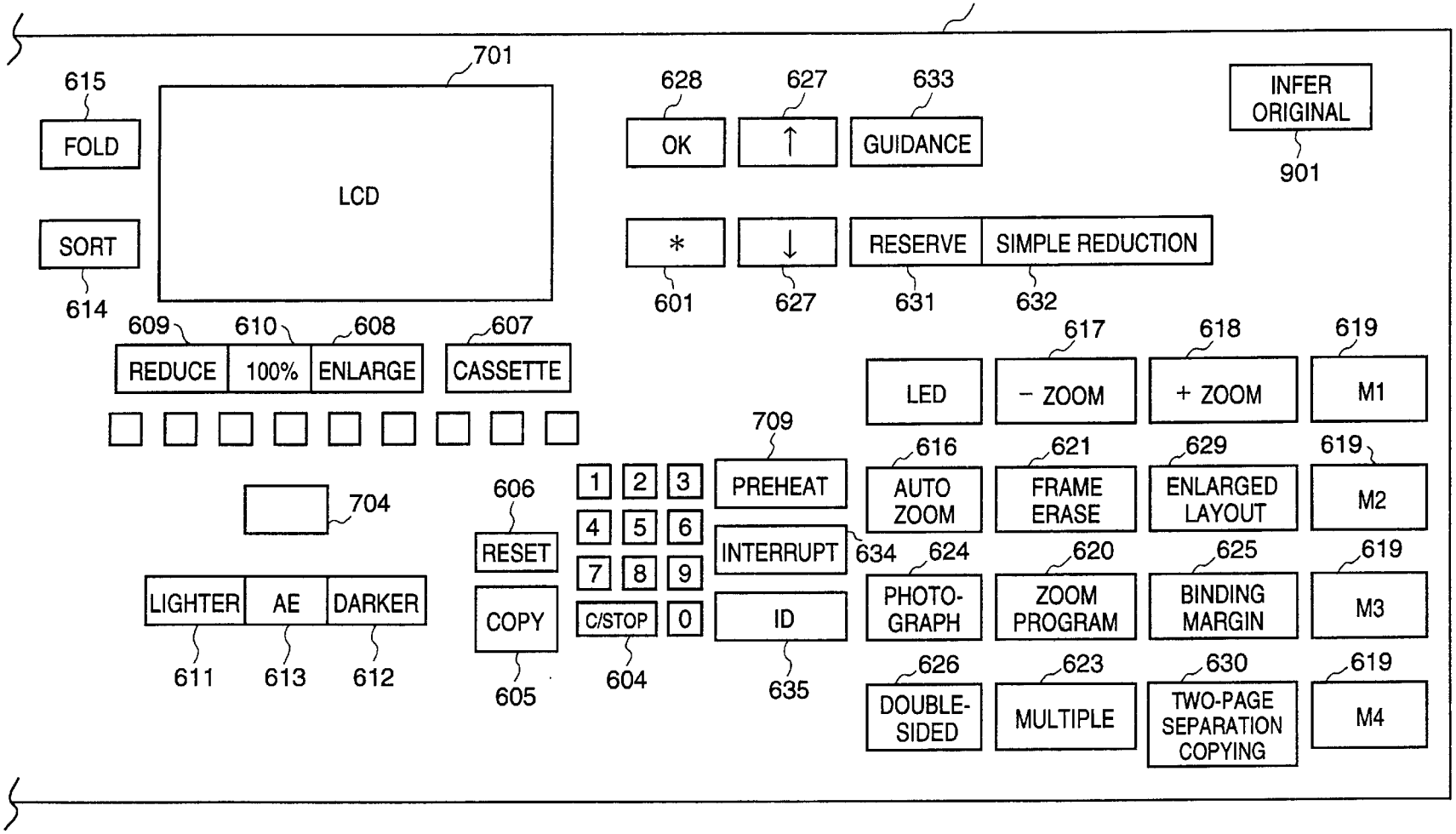
FIG. 11 is a diagram showing an example of the arrangement of the control panel on a copier in an example of application.
Figure 12:
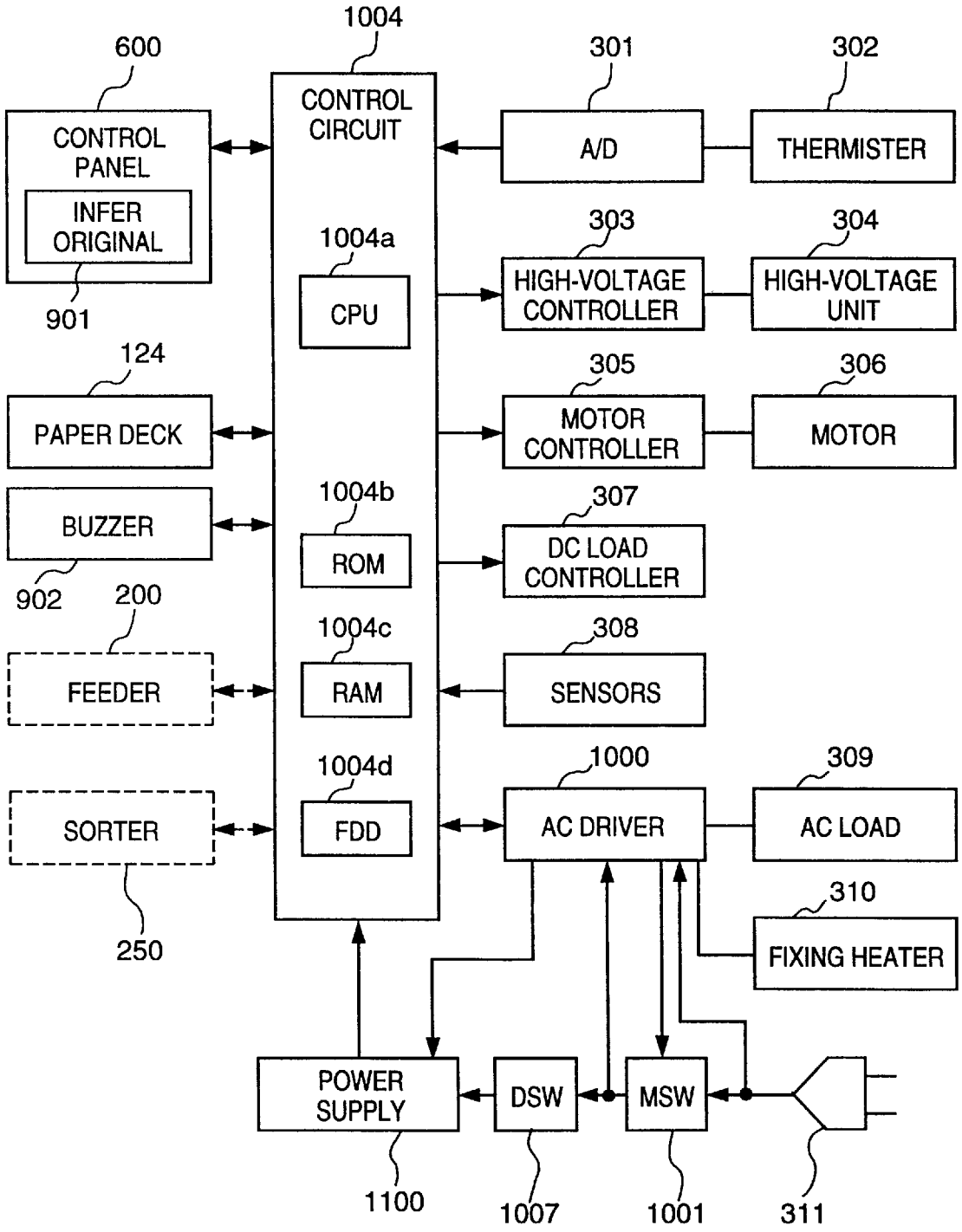
FIG. 12 is a block diagram illustrating an example of the architecture of the control system of a copier in an example of application.

In an example of an application of the invention directed to solving the above-mentioned problem, a function is provided in which use of the above-described original-document inferring function may be selected or not selected. FIG. 11 is a diagram showing an example of the arrangement of the control panel 600 on a copier in an example of application, and FIG. 12 is a block diagram illustrating an example of the architecture of the control system of the copier in the example of application. It should be noted that elements identical with those of the embodiment described above are designated by like reference characters and need not be described again.

A document inference key 901 is for switching between a state in which document size and orientation are inferred and a state in which these are not inferred. The on/off state of the document inference function (i.e., whether the function is active or inactive) is displayed on the message display 701, by way of example.

A buzzer 902 (FIG. 12) is used to issue a warning at a prescribed timing if the function for inferring the original is OFF and, moreover, the size of the original cannot be sensed. The means for issuing this warning is not limited to the buzzer 902. For example, the warning may be a display presented on the message display 701 or the like.

The timing at which the warning is outputted may be when it is decided at step S703 in the flowchart of FIG. 7 that the size of the original cannot be sensed, when it is decided at step S702 that the prevailing mode is the document-size using mode or when it is decided at step S701 that the prevailing mode is the pressure-plate mode.

By thus providing a function for turning the document inference function on and off, it is possible to prevent copying mistakes that would accompany unintended document inference processing in the aforesaid case where document inference function is not required. Further, in a case where there is the possibility that it would be better to infer the original document (as when the size thereof cannot be sensed), providing the means that warns of the fact that the document inference function is OFF makes it possible to limit copying failures that might arise when the document inference function is OFF.

Furthermore, the warning means such as the buzzer 902 can be utilized even when the document inference function is ON, for example. For instance, if it is decided at step S703 that the document size is capable of being sensed when the document inference function is ON, the program proceeds directly to step S707 and copying is performed in accordance with the description rendered above. Even in this case, however, control may be exercised in such a manner that the document inference processing (steps S704~S706) is executed, the document size and orientation inferred are compared with document size and orientation sensed by the sensors, the program proceeds to step S707 if agreement is detected and, if agreement is not detected, a warning is issued using the warning means such as the buzzer 902. This makes it possible to call the operator's attention to the fact of non-agreement.

The present invention can be applied to a system constituted by a plurality of devices or to an apparatus comprising a single device. Further, it goes without saying that the invention is applicable also to a case where the invention is implemented by supplying the system or apparatus with a program. In such case a storage medium storing a program in accordance with the invention constitutes the invention. By reading the program from the storage medium to the system or apparatus, the system or apparatus operates in a predetermined manner.

Thus, as described above, the shape of an original is inferred from the type of set copy paper and copying mode, thereby reducing copying mistakes and making copying processing more efficient.

Further, by adding on a control program which infers the shape of the original, this function can be implemented. This makes it possible for an existing copier to be readily improved by this control program.

As many apparently widely different embodiments of the present invention can be made without departing from the spirit and scope thereof, it is to be understood that the invention is not limited to the specific embodiments thereof except as defined in the appended claims.

What is claimed is:

1. A copier apparatus comprising:

mode setting means for setting a copying mode in which an image of a document is copied;

paper selection means for selecting a recording paper;

first sensing means for sensing size of the paper selected by said paper selection means;

second sensing means for sensing size of the document; and inferring means for inferring size of the document based upon the copying mode set by said mode setting means and the size of the paper sensed by said first sensing means if the size of the document cannot be sensed by said second sensing means.

2. The apparatus according to claim 1, wherein said inferring means infers the size of the document if the copying mode set by said mode setting means is a mode in which the size of the document is used as a parameter.

3. The apparatus according to claim 2, wherein the mode in which the size of the document is used as a parameter includes a mode in which the image of the document is divided up into a plurality of blocks, images of respective ones of the blocks are enlarged and the enlarged images are copied on separate respective sheets of recording paper.

4. The apparatus according to claim 2, wherein the mode in which the size of the document is used as a parameter includes a mode in which the image of the document is reduce and the reduced image is copied upon the recording paper whose size is the same as that of the document.

5. The apparatus according to claim 1, further comprising selection means for selecting whether operation of said inferring means to be rendered active or inactive.

6. The apparatus according to claim 5, further comprising warning means for issuing an alarm in a case where operation of said inferring means has been selected to be inactive by said selection means and the size of the document cannot be sensed by said second sensing means.

7. A copier apparatus comprising:

document size sensing means for sensing size of a document greater than a predetermined standard size;

mode setting means for setting a mode in which an image of a document is copied;

paper size sensing means for sensing size of recording paper used to copy the image of a document; and inferring means for inferring size of a document smaller than the predetermined standard size based upon the copying mode set by said mode setting means and the size of the paper sensed by said paper size sensing means in a case where said document size sensing means cannot sense the size of the document.

8. The apparatus according to claim 7, wherein said inferring means infers the size of the document if the copying mode set by said mode setting means is a mode in which the size of the document is used as a parameter.

9. The apparatus according to claim 7, wherein said inferring means infers the size of the document if the copying mode set by said mode setting means is a mode in which the size of the document is used as a parameter.

10. The apparatus according to claim 9, wherein the mode in which the size of the document is used as a parameter includes a mode in which the image of the document is divided up into a plurality of blocks, images of respective ones of the blocks are enlarged and the enlarged images are copied on separate respective sheets of recording paper.

11. The apparatus according to claim 9, wherein the mode in which the size of the document is used as a parameter includes a mode in which the image of the document is somewhat reduced and the reduced image is copied upon the recording paper whose size is the same as that of the document.

12. The apparatus according to claim 7, further comprising selection means for selecting whether operation of said inferring means is to be rendered active or inactive.

13. The apparatus according to claim 12, further comprising warning means for issuing an alarm in a case where operation of said inferring means has been selected to be inactive by said selection means and the size of the document cannot be sensed by said document size sensing means.

14. A method of controlling a copier apparatus, comprising the steps of:

a) setting a copying mode in which an image of a document is copied;

b) selecting a recording paper;

c) sensing size of the paper selected at step b;

d) sensing size of the document; and e) inferring a size of the document based upon the copying mode set at step a and the size of the paper sensed at step c if a size of the document cannot be sensed at step d.

15. The method according to claim 14, wherein step e is executed if the copying mode selected at step a is a mode in which the size of the document is used as a parameter.

16. The method according to claim 15, further comprising a step f of selecting whether operation of step e to be rendered active or inactive.

17. The method according to claim 16, further comprising a step of issuing an alarm in a case where operation of step e has been selected to be inactive at step f and the size of the document cannot be sensed at step d.

18. The method of claim 14, further comprising a step f of selecting whether operation of step e is to be rendered active or inactive.

19. The method according to claim 18, further comprising a step of issuing an alarm in a case where operation of step e has been selected to be inactive at step f and the size of the document cannot be sensed at step d.

20. A method of controlling a copier apparatus, comprising the steps of:

a) sensing size of a document greater than a predetermined standard size;

b) setting a mode in which an image of a document is copied;

c) sensing size of recording paper used to copying the image of a document; and d) inferring size of a document smaller than the predetermined standard size based upon the copying mode set at step b and the size of the paper sensed at step c in a case where the size of the document cannot be sensed at step a.

21. The method according to claim 20, wherein step d is executed if the copying mode selected at step a is a mode in which the size of the document is used as a parameter.

* * * * *

UNITED STATES PATENT AND TRADEMARK OFFICE

CERTIFICATE OF CORRECTION

PATENT NO. : 5,815,786

DATED : September 29, 1998

INVENTOR(S) : Keizo Isemura

It is certified that error appears in the above-identified patent and that said Letters Patent is hereby corrected as shown below:

Column 12, line 26, change "f" to --e--.

Column 12, line 26, change "e" to --d--.

Column 12, line 30, change "e" to --d--.

Column 12, line 30, change "f" to --e--.

Column 12, line 31, change "d" to --c--.

Signed and Sealed this

Ninth Day of March, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,815,786

DATED : September 29, 1998

INVENTOR(S) : KEIZO ISEMURA

It is certified that error appears in the above-identified patent and that said Letters Patent is hereby corrected as shown below:

COLUMN 2,
Line 23, "a angle" should read --an angle--; and
Line 45, "In FIG. 2A" should read --FIG. 2A--.

COLUMN 4,
Line 54, "are" should read --is--.

COLUMN 8,
Line 46, "be" should read --by--.

Signed and Sealed this

Eleventh Day of May, 1999

*Attest:*

Q. TODD DICKINSON

*Attesting Officer*

*Acting Commissioner of Patents and Trademarks*